United States Patent [19]

Bouloy

[11] 4,255,941

[45] Mar. 17, 1981

[54] ICE MAKING MACHINE AND METHOD

[76] Inventor: Jose B. Bouloy, 519 S.E. Euclid Lane, Port St. Lucie, Fla. 33452

[21] Appl. No.: 100,412

[22] Filed: Dec. 5, 1979

[51] Int. Cl.[3] ..... F25C 1/04

[52] U.S. Cl. ..... 62/347; 62/348; 62/523; 165/115; 249/119; 249/129; 249/133

[58] Field of Search ..... 62/347, 348, 515, 74, 62/523; 165/115, 170; 249/119, 120, 129, 133

[56] References Cited

U.S. PATENT DOCUMENTS

| | | | |
|---|---|---|---|
| 82,593 | 9/1868 | Cammerer | 165/115 |
| 1,545,893 | 7/1925 | Gregory | 165/115 |
| 2,129,473 | 9/1938 | Mojonnier et al. | 165/115 |
| 2,493,270 | 1/1950 | Smith | 249/119 |
| 2,949,752 | 8/1960 | Bayston | 62/348 X |
| 3,054,274 | 9/1962 | McGhee et al. | 62/348 X |
| 3,778,018 | 12/1973 | Abalo | 249/119 X |
| 4,107,943 | 8/1978 | Ohling | 62/347 X |

*Primary Examiner*—William E. Tapolcai, Jr.

[57] ABSTRACT

An evaporator unit for an ice making machine is formed of two vertical series of semi-cylindrical ice-forming molds joined tangentially back-to-back creating a cascade of fluid conduits between them through which refrigerant is passed. Water flows from a weir down over the exposed surfaces of the ice-forming molds until they become filled with ice whereupon hot gas is momentarily passed through the fluid conduits to release an assembly of ice pieces from the evaporator unit. Thereafter, the ice making cycle is repeated by continuing the water and refrigerant flow to produce another assembly of ice pieces.

9 Claims, 6 Drawing Figures

FIG. 1
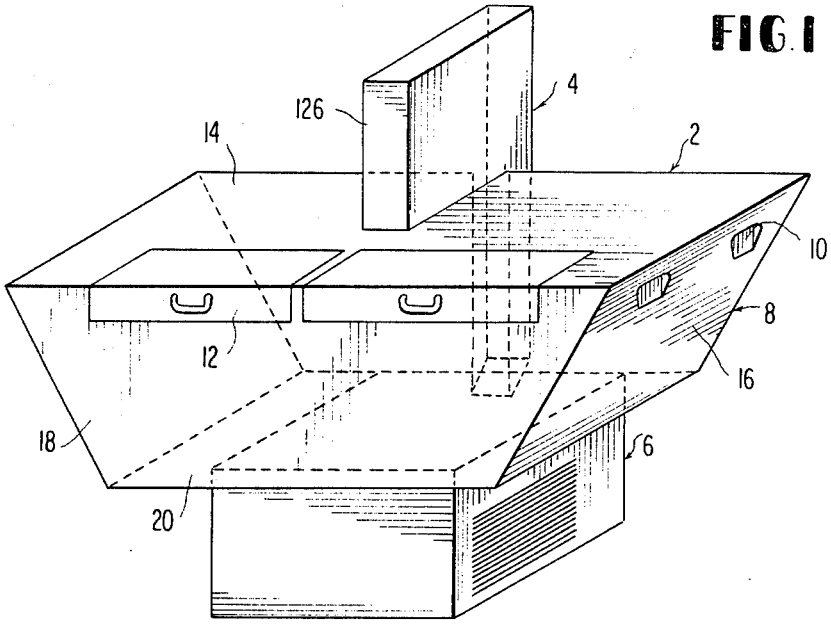
FIG. 3
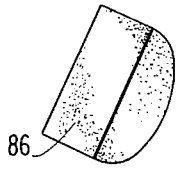
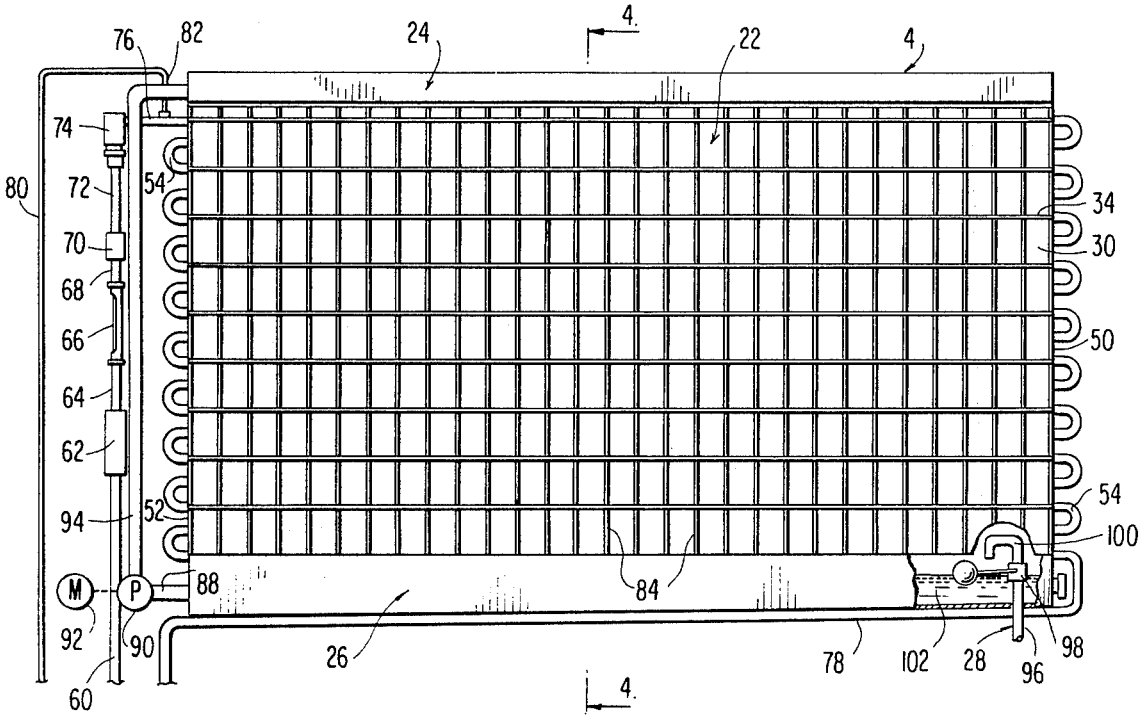
FIG. 2

ICE MAKING MACHINE AND METHOD

BACKGROUND OF THE INVENTION

1. Field of the Invention

This invention broadly relates to machines for automatically making small pieces of ice. More particularly, it concerns improved forms of evaporator units comprising a grid of ice-forming molds for such machines.

2. Description of the Prior Art

The extensive use of ice pieces (so-called "ice cubes") for cooling of drinks, preserving food, etc., has created a sizeable market for machines that automatically make and store ice pieces in response to user demand. Typically, such machines comprise an evaporator unit wherein refrigerant is brought in indirect heat exchange with water recycled from a sump over an ice-forming surface. After a sufficient quantity of ice is formed, the resulting ice pieces are separated from the ice-forming surface, e.g., by momentarily heating the surface by reverse cycling of gas from the compressor unit. An ice making machine of this general type is disclosed, for example, in U.S. Pat. No. 2,997,861.

Some machines of this type are constructed so that ice pieces of various shapes may be produced, e.g., see U.S. Pat. No. 3,171,267. However, ice piece shape variation is not considered of much importance for automatic ice making machines and the present invention concerns machines that produce a single shape of ice piece, namely, pieces of substantially semi-cylindrical shape.

One of the problems in production and use of ice making machines is the construction of ice forming molds for the machines, e.g., see U.S. Pat. Nos. 3,075,365 and 3,736,767. Such molds must provide effieicent use of refrigerant, permit sanitary operation for the ice formation and allow ice pieces when formed to be easily harvested and stored ready for use. The present invention concerns improvements in the evaporator and ice molding sections of automatic ice making machines.

OBJECTS

A principal object of this invention is the provision of new, improved evaporator units for ice making machines.

Another object is the provision of molds for forming ice pieces in automatic ice making machines that are highly efficient in the use of energy, relatively inexpensive to manufacture and permit sanitary ice formation to be easily maintained.

A further object is the provision of new methods of forming ice pieces using improved ice making equipment of the invention.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the invention by forming evaporator units for automatic ice-making machines from two series of semi-cylindrical ice-forming molds joined tangentially back-to-back to provide a cascade of fluid conduits by the spaces that are created between the joined mold members. The fluid conduits conduct refrigerant from a compressor unit along the back surface of the semi-cylindrical molds for indirect heat exchange with water flowing over the front surfaces of the molds from a distribution weir positioned above the top edge of the ice-forming mold assembly.

Stated in more detail, an essential portion of the new ice-making machines of the invention is an evaporator unit in which the ice pieces are formed which comprises:

a first series of ice-forming molds, each mold of the series being substantially a semi-cylinder, the molds having their longitudinal axis parallel to one another and beng joined tangentially at the lip thereof to adjacent molds with the joined lips lying in a plane, a second series of ice-forming molds structured similarily to the first series, the first and second series of molds being assembled in back-to-back tangential contact forming therebetween a cascade of fluid conduits of approximately triangular cross-section, the longitudinal axis of the conduits being substantially parallel to the longitudinal axis of the ice-forming molds, conduit means at the end of the fluid conduits joining the fluid conduits for seriatim flow of fluid there through, weir means at one end of the assembly of first and second molds for flowing water over the exposed surfaces of the ice-forming molds, and collector means at the end of the assembly opposite to the weir means for receiving water discharged from the ice-forming molds.

The evaporator unit advantageously includes a pump by which water from the collector means at the bottom of the mold assembly is circulated to the weir means at the top and there is a water-level controlled valve for the collector means to provide make-up water to the unit as needed from a water line or other potable water source.

In new methods of making molded ice pieces with ice making machine constructed in accordance with the invention, water flows from the weir means over the exposed surfaces of the ice-forming molds while the molds are cooled by refrigerant flowing seriatim through the fluid conduits, collecting excess water discharged from the molds in the collector means, recycling water from the collector means to the weir means, continuing the water flow over the exposed surfaces until the molds are filled with ice, then stopping the cooling of the molds, momentarily heating the molds by flowing hot fluid through the fluid conduits and allowing an assembly of molded ice pieces to drop from the ice-forming molds.

BRIEF DESCRIPTION OF THE DRAWINGS

A more complete understanding of the invention may be obtained by reference to the accompanying drawings in which identical parts bear the same numerical designations and wherein:

FIG. 1 is an isometric view of an ice-making machine of the invention

FIG. 2 is a lateral view of the evaporator unit of the ice-making machine

FIG. 3 is an isometric view of a molded ice piece produced by the ice-making machine

DESCRIPTION OF PREFERRED EMBODIMENTS

Figure 4:
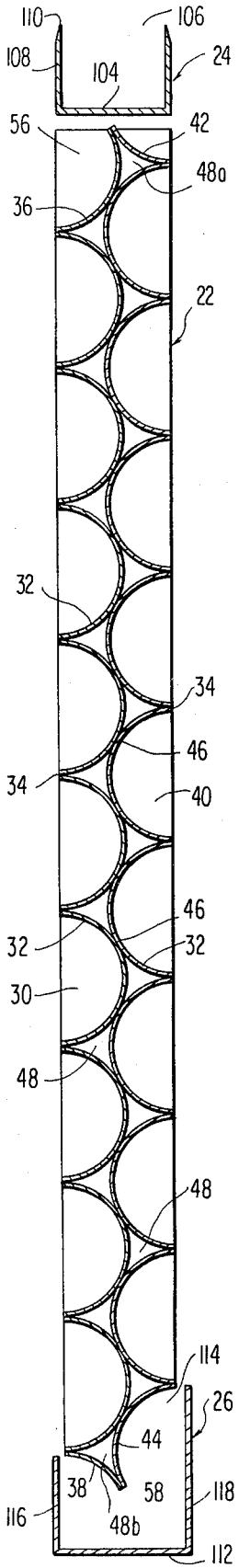
FIG. 4 is a sectional view taken on the line 4—4 of FIG. 2.

Referring in detail to the drawings, the ice-making machine 2 basically comprises an evaporator unit 4, refrigeration unit 6 and ice storage bin 8.

The refrigeration unit 6 can be of conventional design to include a compressor, driving motor, condensor, cooling fan for the condensor, etc. (these elements not being shown, but see for example FIG. I of U.S. Pat. No. 3,171,267).

The storage bin 8 is shown with side handles 10, front access hatches 12 in the flat top 14, rectangular sides 16, traposidial front and rear 18 and rectangular bottom 20. However, the design of bin 8 is not critical and may be varied to meet the space and capacity requirements of different users. The materials of construction of the bin 8 may also be varied and will, of course, be selected to provide maximum insulation with minimum cost.

While the refrigeration unit 6 and storage bin 8 are part of the complete ice-making machine 2 the present invention primarily involves the evaporator unit 4.

The unit 4 basically comprises a mold section 22, weir means 24, collector means 26 and valve means 28.

The mold section 22 comprises a first series 30 of semi-cylindrical molds 32 having their longitudinal axis parallel to one another. Each mold is joined tangentially at the lips 34 thereof to the adjacent molds 32. The uppermost mold 36 and lowermost mold 38 are arcuate portions only of semi-cylinders. The mold section 22 also comprises a second series 40 of semi-cylindrical molds 32 like those of series 30 with parallel longitudinal axis and joined at their lips 34. The uppermost mold 42 and lowermost mold 44 of series 40 are substantially like molds 36 and 38 respectively of series 30. As seen in FIG. 4 the lips 34 of series 30 lie in a plane as do lips 34 of series 40.

The mold series 30 and 40 are assembled back-to-back to make tangential contacts 46 with each other. The molds 32 at these points of contact 46 can be united such as by welding, cementing, etc., so that there is produced between the mold series 30 and 40 a cascade of fluid conduits 48 of approximately triangular cross section. At the sides 50 and 52, U-shaped tubes 54 are welded or otherwise joined to the ends of the conduits 48 so that fluid may flow seriatim through the conduits 48 from the upper end 56 of the mold section 22 to the lower end 58.

A tube 60 rising from the refrigeration unit 6 connects via the in-line drier 62, nipple 64, sight-glass 66, nipple 68, high-side coupling 70, nipple 72, expansion valve 74 and nipple 76 to the top conduit 48*a* of the mold section 22. Thus, refrigerant may be passed into and through the mold section 22 via the tube 60 and its related elements.

The bottom conduit 48*b* of the mold section 22 is joined to the return tube 78 so that refrigerant exiting from the mold section 22 may be recycled to the refrigeration unit 6.

A hot-gas line 80 is joined at upper end 82 to the nipple 76 so that when refrigerant flow into the evaporator unit 4 is stopped, hot gas may be passed through it via the line 80 from the refirgeration unit 6 with by-pass of the condensor according to known operating procedure.

The mold section 22 has a multiplicity of vertical contoured webs 84 fitted into the molds 32 & 36 in mold series 30 and into molds 32 & 42 of mold series 40 so that such horizontal molds are divided into a multi-cavity mold grid, each cavity of which has a shape corresponding to the ice pieces 86 that are formed by machine 2.

The weir means 24 is joined via tube 88, pump 90 driven by motor 92, and the tube 94 for flow of water from collector means 26.

The valve means 28 comprises inlet tube 96, float-controlled valve 98 and outlet nozzle 100. It is used to introduce water as needed from external source (not shown) to the collector means 26 to maintain a relatively constant level of water 102 therein.

The weir means 24 has bottom 104, open top 106 and sides 108 that terminate in weir edges 110. As shown it is of rectangular cross-section. However, it may be of arcuate or other cross-section provided that it possesses weir edges similar to edges 110. The weir means 24 may be formed of metal, plastic, fiber-reinforced plastic or the like by molding, pressing, rolling or other suitable favriaction operation.

The collector means 26 has a bottom 112, open top 114, short side 116 and long side 118 forming a cross-section of trapisodial shape. However, it may be of arcuate cross-section, similar to a lopsided dish, or of other shape so long as it serves to catch the water that flows off the bottom end 58 of mold section 22. It may be formed of materials and by methods as described for the weir means 24.

The mold section 22 can be constructed of various suitable materials and in a variety of ways. Preferably, the mold series 30 and 40 are formed of heat conductive metals such as copper, aluminum or their alloys. However, they may be made of other metals, plastics, etc. One method of making the sections 30 and 40 is to spot weld together at the lips 34 the required number of separate semi-cylindrical elements 32 and then place these back-to-back and weld them at the junction points 46. Another way is to stamp the sections 30 and 40 from a sheet of metal or plastic and then join them back-to-back by welding or cementing. Yet another method is to form the entire section 22 in one operation from metal or plastic by casting or molding. In any event, a mold section 22 when constructed as shown and described is highly efficient as regards ice forming ability and relatively inexpensive to manufacture.

Figure 5:
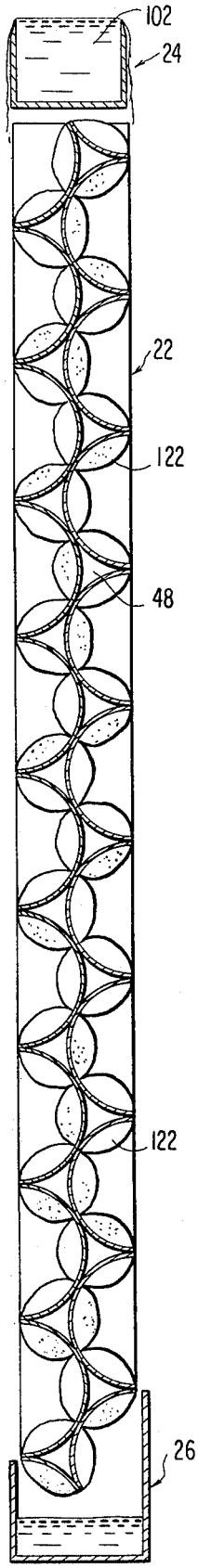
FIG. 5 is a sectional view similar to FIG. 4, but showing ice pieces in partial state of formation in the evaporator unit
Figure 6:
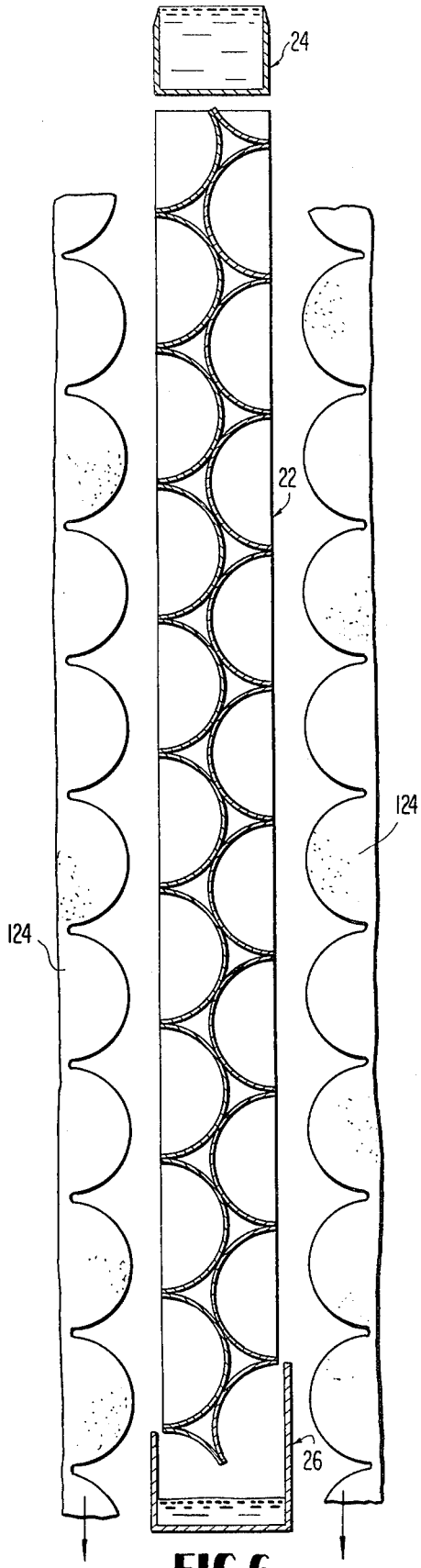
FIG. 6 is a sectional view similar to FIG. 4 showing an assembly of molded ice pieces dropping from the evaporator unit.

The new methods of ice piece making of the invention can be best described with references to FIGS. 5 and 6. Water 102 from the collector means 26 is pumped via tubes 88 and 94 to the weir means 24. The water flows over the weir edges 110 and down over the exposed surfaces of the mold section 22. Initially, small clusters of ice 122 will form over the surfaces of molds 32 at the conduits 48. As the flow of water continues, these ice clusters will grow until the entire volume of the molds 32 are filled with ice. At this point, the flow of refrigerant from the refrigeration unit 6 through the conduits 48 is stopped and a surge of hot gas is passed via tube 80 through the conduits 48. This short surge of hot gas causes the ice attached to the surface of the molds 32 to melt. This causes the assemblies 124 of ice pieces to break loose from the molds and fall into the storage bin 8 from which they can be obtained through the hatches 12. The ice pieces and the evaporator unit are protected from contact with persons obtaining ice by the decorative cover 126.

The embodiments of the invention in which an exclusive property or privilege is claimed are defined as follows:

1. An ice machine evaporator unit comprising:

a first series of ice-forming molds, each mold of the series being substantially a semi-cylinder, said molds having their longitudinal axis parallel to one another and being joined tangentially at the lip thereof to adjacent molds with the joined lips lying in a plane, a second series of ice-forming molds structured similarly to said first series, said first and second series of molds being assembled in back-to-back tangential contact forming therebetween a cascade of fluid conduits of approximately triangular cross-section, the longitudinal axis of said conduits being substantially parallel to the longitudinal axis of said ice-forming molds, conduit means at the ends of said fluid conduits joining said fluid conduits for seriatim flow of fluid there through, weir means at one end of said assembly of first and second molds for flowing water over the exposed surfaces of said ice-forming molds, and collector means at the end of said assembly opposite to said weir means for receiving water discharged from said ice-forming molds.

2. The evaporator unit of claim 1 wherein said weir means is a trough of rectangular cross-section with an open top.

3. The evaporator unit of claim 1 wherein said collector means is a trough of trapesodial cross-section with an open top.

4. The evaporator unit of claim 1 which comprises pump means to circulate water from said collector means to said weir means.

5. The evaporator unit of claim 1 wherein said plane in which said joined lips lie is a substantially vertical plane and said longitudinal axis of said semi-cylinders run substantially horizontally.

6. The evaporator unit of claim 5 wherein there are a multiplicity of vertical contoured webs that subdivide said horizontal semi-cylinders into a multi-cavity mold grid.

7. The evaporator unit of claim 6 wherein said weir means is positioned longitudinally above the top of said mold grid and said collector means is positioned longitudinally below the bottom of said mold grid.

8. The evaporator unit of claim 1 that is connected to a refrigeration unit for circulation of refrigerant through said fluid conduits.

9. The evaporator unit of claim 1 having float controlled valve means for discharging make-up water into said collector means.

* * * * *